US006099274A

United States Patent [19]

Conn

[11] Patent Number: 6,099,274

[45] Date of Patent: Aug. 8, 2000

[54] PUMP TO SURFACE PUMP

[76] Inventor: Kenneth S. Conn, 29 Lang Crescent S.W., Medicine Hat Alberta, Canada, T1A 4P6

[21] Appl. No.: 09/045,049

[22] Filed: Mar. 20, 1998

Related U.S. Application Data

[60] Provisional application No. 60/041,028, Mar. 21, 1997.

[51] Int. Cl.[7] ..... F04B 39/10

[52] U.S. Cl. ..... 417/547; 417/378; 417/423.11; 417/444; 417/375; 417/469; 417/554; 92/158; 92/160; 277/58; 277/68

[58] Field of Search ..... 417/378, 388, 417/390, 546, 547, 423.11, 444, 375, 469, 554; 277/173, 68, 58; 92/158, 160; 166/68.5, 68, 105.6, 105.1, 105.2, 105.3, 105.4, 105.5, 106

[56] References Cited

U.S. PATENT DOCUMENTS

| | | | |
|---|---|---|---|
| 3,697,194 | 10/1972 | Holmes | 417/54 |
| 3,765,482 | 10/1973 | Harrison | 166/106 |
| 3,773,441 | 11/1973 | Schertz | 417/554 |
| 4,013,387 | 3/1977 | Gage | 417/554 |
| 4,190,113 | 2/1980 | Harrison | 166/311 |
| 4,493,383 | 1/1985 | Williams et al. | 175/234 |
| 4,661,052 | 4/1987 | Ruhle | 417/552 |
| 4,711,299 | 12/1987 | Caldwell et al. | 166/105.1 |
| 4,762,474 | 8/1988 | Dartnall | 417/469 |
| 4,773,834 | 9/1988 | Saruwatari | 418/48 |
| 4,778,355 | 10/1988 | Holland | 417/378 |
| 4,907,953 | 3/1990 | Hebert et al. | 417/444 |
| 4,949,758 | 8/1990 | Bear | 138/177 |
| 5,088,745 | 2/1992 | Peppiatt et al. | 277/58 |
| 5,095,976 | 3/1992 | Appleton | 166/105.1 |
| 5,494,102 | 2/1996 | Schulte | 166/105.6 |
| 5,639,227 | 6/1997 | Mills | 417/423.11 |
| 5,651,666 | 7/1997 | Martin | 417/375 |
| 5,752,814 | 5/1998 | Starks et al. | 417/554 |
| 5,915,475 | 6/1999 | Wells et al. | 166/68.5 |

FOREIGN PATENT DOCUMENTS

| | | |
|---|---|---|
| 701761 | 1/1965 | Canada . |
| 2016311 | 10/1994 | Canada . |
| 1334733 | 3/1995 | Canada . |

OTHER PUBLICATIONS

Brochure–"Positive Seal Sand–Pump", Quinn Pump Division, Quinn's Oilfield Supply Ltd., P.O. Box 846, Red Deer Alberta, T4N 5H2, Canada; (403) 347–1128.

Brochure–"Positive Seal Sand Plunger", Quinn Pump Division, Quinn's Oilfield Supply Ltd., P.O. Box 846, Red Deer Alberta, T4N 5H2, Canada; (403) 347–1128.

*Primary Examiner*—Teresa Walberg
*Assistant Examiner*—Leonid Fastovsky
*Attorney, Agent, or Firm*—Millen, White, Zelano & Branigan, P.C.

[57] ABSTRACT

A reciprocating pump is provided for pumping subterranean fluids containing fine solids to surface. The pump comprises a pump barrel, piston and piston rod. The piston rod is suspended form reciprocating production tubing. The barrel is anchored in the casing of a well. A standing valve is located at the bottom of the barrel. The piston and travelling valve are located at the bottom of the piston rod for minimizing the dead-space between standing and travelling valves. Upper and lower stacks of hydraulic piston seal rings are positioned on the piston above and below the travelling valve for minimizing piston height. Each seal has radially flared lips at its leading edge. The piston spaced grooves formed therein, corresponding to the seal ring flared lips. At least the lower seal stack is axially movable so that the flared lips alternate between being compressed against the piston during the pumping stroke and being engaged with their respective grooves on the return stroke thereby relaxing the lips and releasing pressure trapped between the upper and lower seals. A barrel wiper at the lower seal ensures sand is excluded from the lower seal. Large bore flow passages are provided in the piston rod and valves while providing complementary piston rod and pump barrel means for enabling piston rod reciprocating motion while still rotary actuation of the anchor.

18 Claims, 11 Drawing Sheets

9
9
49
31b
49
41
27
27
27
28
27
27
27
44
22
8
8
20
23
44
27
27
27
28
27
27
27
41
42
31
43

PUMP TO SURFACE PUMP

This application claims priority of U.S. Provisional application Ser. No. 60/041,028 filed Mar. 21, 1997.

FIELD OF THE INVENTION

The invention relates to oil wells which produce a large fraction of sand and reciprocating pumps and seals capable of pumping such sand and oil on a continuous basis.

BACKGROUND OF THE INVENTION

In Southern Alberta, Canada, heavy oil is sometimes recovered from unconsolidated sandstone formations using a technique called cold production. The operator of the well aggressively perforates the well and purposefully produces formation sand along with the heavy oil. This technique pulls sand from the formation, increasing oil mobility and formation permeability for improving the flow of viscous oil to the well. Typically sand production is high upon well completion and for a period thereafter. Often a sump is used, located below the perforations for collecting the first inrush of sand. Conventional pumps such as progressive cavity pumps (PCP) or reciprocating rod pumps can be used with sand concentration less that about 20%. PCP's are more tolerant of sand than are reciprocating pumps. However, excessive sand concentrations still persist in some wells. The sump and well can sand-in and sand slugs can pump umps and halt production until an expensive and time-consuming workover clears the sand. Usually, by that time PCP failure has occurred. If a low cost reciprocating pump jack or rotary top drive is used to operate the pump, an expensive service rig must be called in to pull the pump or flush the PCP. Even more costly is to maintain a service rig at the well.

For removing excessive sand and for emptying a sump, prior art techniques include using a reciprocating barrel pump with a lower, sand-collecting tailpiece. This process is termed "bailing". The pump is located above the tailpiece. The pump draws solids and liquid into the tailpiece. Solids settle and liquid continues upwardly to spill back into the annular space between the pump barrel and the wellbore. Solids collect until the tailpiece is full and it is pulled out of the well.

In U.S. Pat. No. 4,711,299 to Caldwell, a reciprocating barrel pump is applied to a well with solids, and more specifically a well having undesirable liquids which need to be pumped out of the well. The pump barrel is suspended from a tubing string. An upper check valve is fitted at the top of the barrel. A stationary piston having a hollow piston rod hangs from and below the barrel. A tailpiece is once again provided which hangs from the piston rod. A lower check valve is fitted at the bottom of the piston rod, adjacent or within the tailpiece. When the barrel reciprocates, sand and liquid is drawn into the tailpiece. The entrance to the piston rod is purposefully narrow to cause high velocity liquid flow. Solids are not intended to pass above the lower check valve. In some implementations a screen rejects solids. Liquid continues up through the piston rod and out of the well as required.

Bailers do not pump sand to the surface and must be pulled from the well to remove sand and return the conventional pump to the well.

Others, such as Site Oil Tools and Arrow Oil Tools have converted conventional bailers to systems which pump sand and liquid to the surface by the addition of an anchor. Conversion from liquid only bailer to pumps handling sand as well introduces several operational difficulties. The travelling valve is located at the top of the piston rod which means they can be in the order of 12 feet from the standing valve. Suction created by these arrangements is poor, resulting in loss of pumping. The small bore through the piston rod causes high pressures in the barrel when the piston and piston rod stroke downwardly. At these pressures, sand separates from the oil and pack up in the barrel, and also form wads or balls of sand which can bridge the production tubing or block elbows and valves at the surface. Further, the sand causes significant wear on the moving components of the pump.

Typically, bailers and bailer conversions use "V"-cup packing, such as that use in wellhead rod seals). The packing-type seals are virtually incapable of sustained use when exposed to sand.

Production pumps, which utilize reciprocating rods, seriously impede the flow path to the surface particularly when the rods alternately move contrary to the desired flow of sand-laden oil, cause fall out of sand, and suffer delayed rod fall. Further, the rod pumps and known reciprocating pumps generally use pistons having elastomeric seals snugly supported in individual piston grooves, subject to being rendered ineffective with sand. As shown in a prior art pump in FIG. 1, the piston can be 2–4 feet long, the travelling valve and standing valves are widely spaced and no means are provided for excluding sand.

Sands from the above-described wells are very fine and tend to pack up in the individual piston grooves and render the seals ineffectual. The sand may be likened to a lapping compound, causing high wear and ultimately resulting in barrel failure.

The problems of sanding in heavy oil wells is discussed in a 1995 paper presented at a Heavy Oil Symposium in Calgary, Alberta, "Practical Requirements for Sand Production Implementation in Heavy Oil Applications", by Dusseault, M. B. et al., publication SPE 30259. The authors identify quick removal of bailers and the resulting suction as one of the causes of re-sanding. The authors further suggest improvements such as washing techniques, jet pump to surface techniques, and slow withdrawal of bailers with fluid replacement.

In this paper, the aforementioned authors acknowledge the superiority of PCP over reciprocation pumps, yet describe PCP failures and reiterate the need for effective sand removal and sand-tolerant pumps.

There is thus an expressed need for a pump which replaces the known bailer or bailer conversions, rod pumps and progressive cavity pumps for pumping liquids to the surface from wells having liquids associated with fine solids, particularly cold production heavy oil wells.

SUMMARY OF THE INVENTION

A reciprocating pump is provided for pumping to surface. The pump comprises a pump barrel anchored in the casing of cold production wells, a piston, piston rod, and standing and travelling valves. The pump is capable not only of bailing but is also used in the steady-state production of oil to the surface. This dual role is achieved through a combination of:

- providing large bore flow passages in the piston rod and valves and thus minimizing the separation of sand from oil and packing of sand at obstructions. This is preferably achieved by using a high strength material for the piston rod so that the wall thickness can be minimized and the bore diameter maximized;
- minimizing of the dead-space between standing and travelling valves for improving pump efficiency and minimizing gas-locking by locating the travelling valve at the base of the piston rod and intermediate the upper and lower seals;

providing complementary piston rod and pump barrel for enabling rotary actuation of the anchor, preferably either using a noncircular high strength piston rod and complementary barrel bushing or using a tang and recess, dog clutch like-arrangement; and providing sand-tolerant seal arrangement. More particularly, the piston is fitted with both upper and lower seals. A bore wiper is provided for excluding sand from the lower seal area. Preferably the travelling valve forms part of the piston with upper and lower seals positioned at either end. The positioning of the seals aids in reducing the dead-space and minimizing piston length. In contradistinction with the known art of providing one of more continuous-sealing seal rings in individual grooves, applicant provides one or more seal rings which are have a finite axial movement between a positive sealing and a weakly sealing position upon each stroke for releasing trapped pressure between the upper and lower seals. Preferably the released pressure is directed through ports into bore of the piston rod.

DETAILED DESCRIPTION OF THE PREFERRED EMBODIMENT

Figures 1A, 1B:
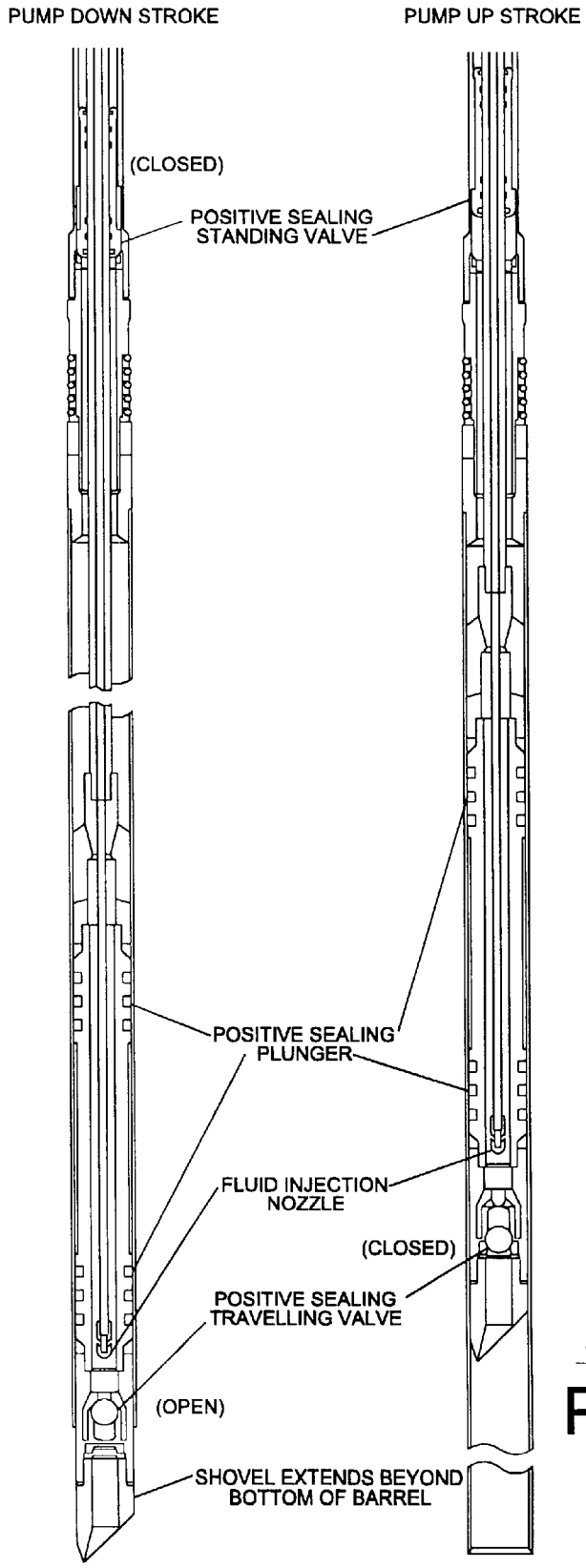
Fig. 1a Prior Art
Fig. 1b Prior Art
FIG. 1*a* is cross-sectional view of a prior art reciprocating pump completing a downstroke.
FIG. 1*b* is cross-sectional view of the prior art pump of FIG. 1*a* completing an upstroke.
Figure 2A:
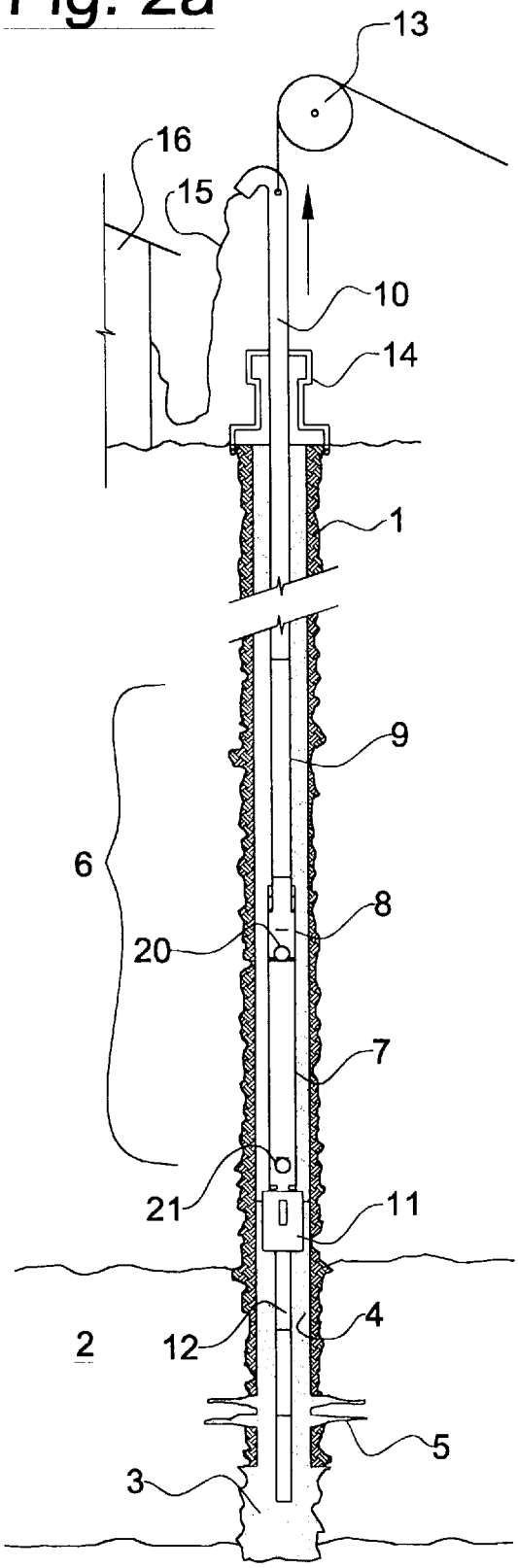
FIG. 2*a* is cross-sectional view of a well completed into a sand and oil producing formation having a reciprocating pump to surface pump of the present invention installed therein. The pump is completing an upstroke.
Figure 2B:
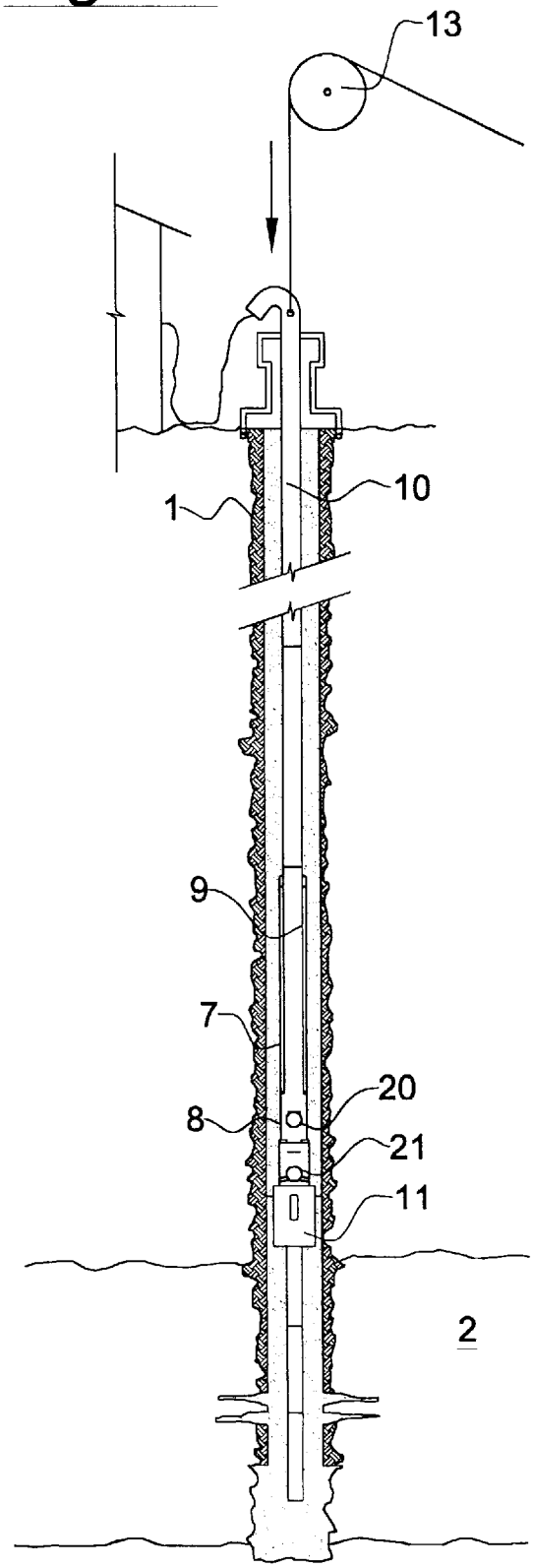
FIG. 2*b* is cross-sectional view of the well and pump to surface pump of FIG. 2*a* wherein the pump is on a downstroke.

Having reference to FIGS. 2*a* and 2*b*, a well 1 is completed into an unconsolidated sandstone formation 2 bearing heavy oil. The well is over-drilled to form a cellar or sump 3. The well is cased 4 and perforated 5. A novel reciprocating pump 6 is installed. In FIG. 2*a* the pump shows an upstroke for pumping to surface and drawing sand and oil into the pump. In FIG. 2*b* the pump is shown at the bottom of the downstroke for cycling just prior to lifting the next charge of sand and oil.

Figure 3:
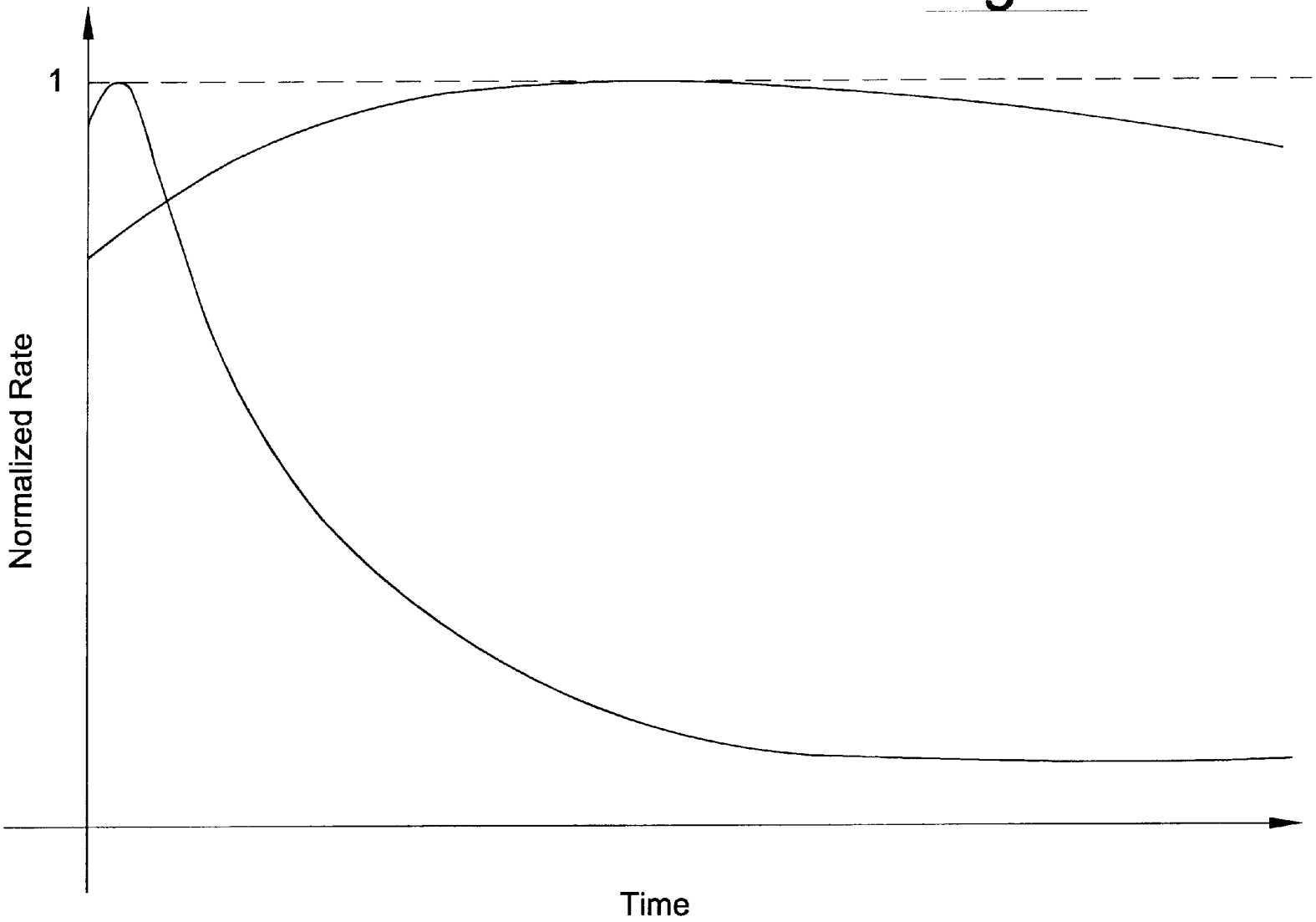
FIG. 3 is a chart of the relative production of sand and fluid from a cold production heavy oil well such as that shown in FIG. 2*a;*

When operated, as shown in FIG. 3, the pump is expected to initially produce a significant amount of sand (dotted line) at a high sand ratios of about 15 to 40% sand-to-oil. This can occur as well after a workover. Over several weeks of steady state operation, the sand ratio typically drops to about 10%. The gross fluid production (solid line) initially rises as the sand ratio drops and then slowly diminishes.

The pump 6 (FIGS. 2*a*, 2*b*) comprises a barrel 7, a piston 8 and a piston rod 9. The piston rod 9 is suspended in the well 1 from production tubing 10. A tension anchor 11 is affixed to the bottom of the barrel 7 for securing the barrel to the casing 4. Additional tubing or a tailpiece 12 extends downwards from the pump barrel 7 and into sump 3, below the perforations 5. The tailpiece 12 extends the pump's suction from the barrel 7, through the anchor 11 and down to the bottom of the tailpiece 12.

Surface equipment 13 causes the production tubing 10 to reciprocate or stroke up and down. A wellhead 14 contains packing for sealing the well 1 to the reciprocating tubing 10. The pump 6 pumps fluid and sand from the sump 3, up the production tubing 10 to the surface, through a hose 15 and into a tank 16.

The pump barrel 7 is stationary, as affixed to the casing 4 by tension anchor 11. The piston rod 9 is axially movable within the barrel 7. The piston 8 is located at the bottom of the piston rod 9. A one way ball or travelling valve 20 is also located at the bottom of the piston rod 9. A one way ball or standing valve 21 is located at the bottom of the barrel 7. Both valves 20,21 utilize Titanium 2¼" balls and oversized 2⅛" seats modified from 2" stock valves available from Harbison-Fischer Canada Ltd, Calgary, Alberta, Canada.

Figure 7A:
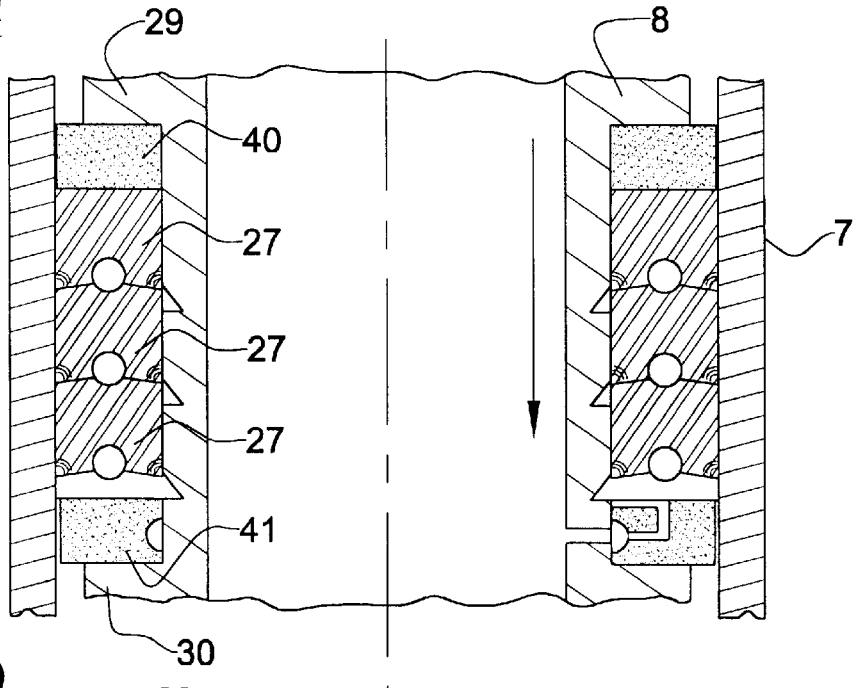
FIG. 7*a* is a simplified diagrammatic representation of a cross-section of the lower piston seal which demonstrates the pump's downstroke and the positive sealing achieved by the seal rings against both the piston and the barrel.
Figure 8A:
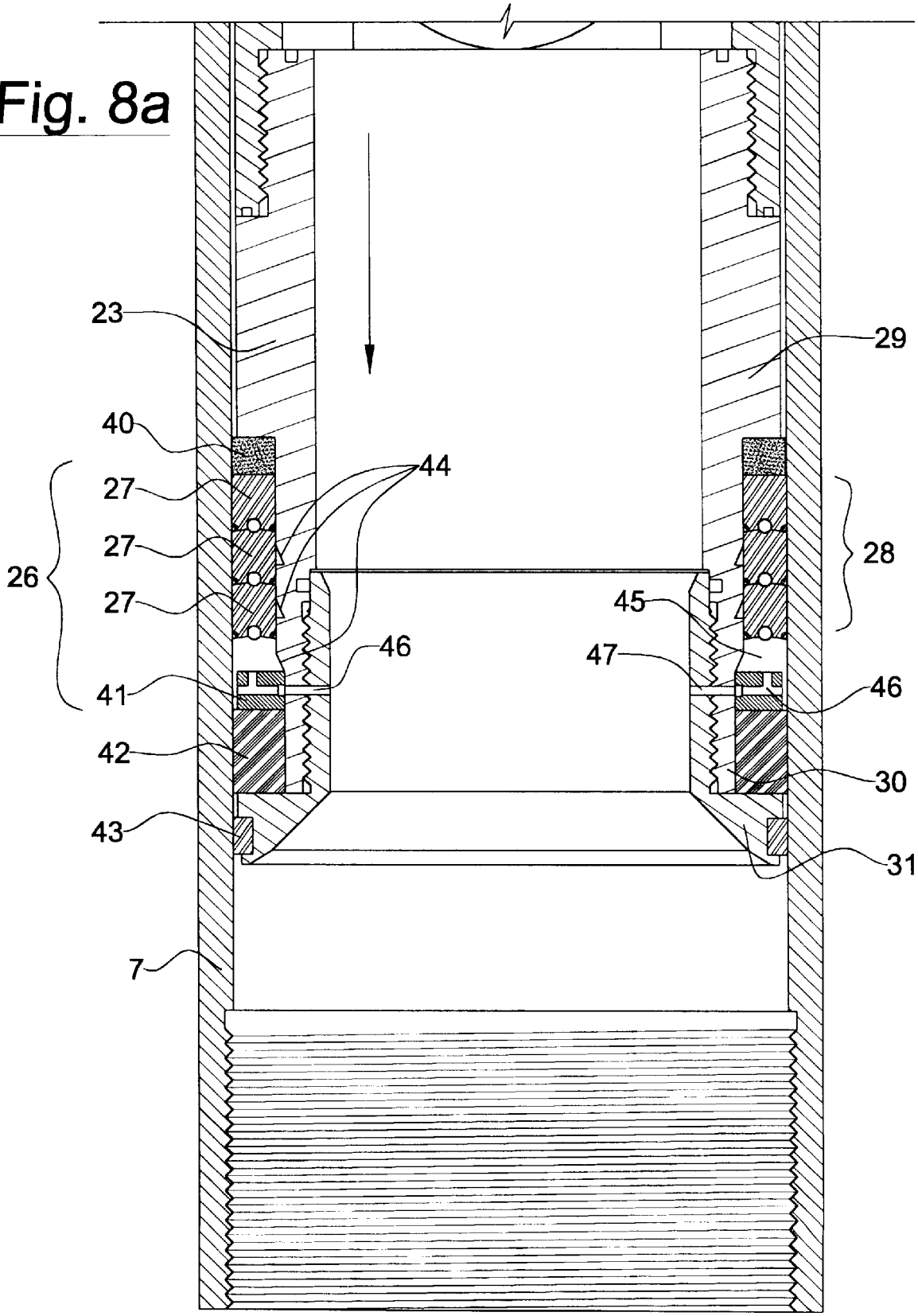
FIG. 8*a* is a cross-sectional view of a preferred embodiment of the pump corresponding to FIG. 7*a;*
Figure 8B:
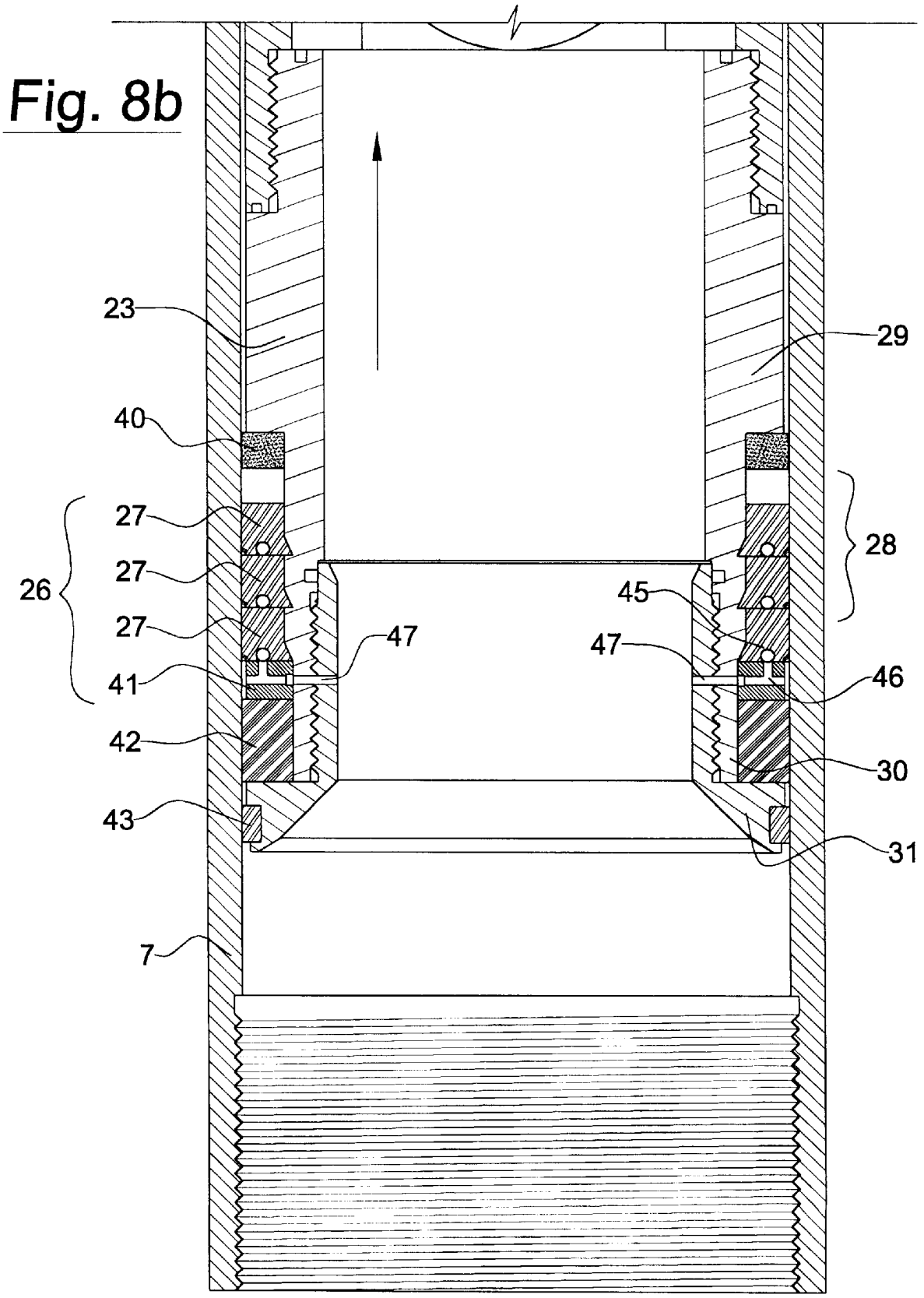
FIG. 8*b* is a cross-sectional view of a preferred embodiment of the pump corresponding to FIG. 8*b;*
Figure 9:
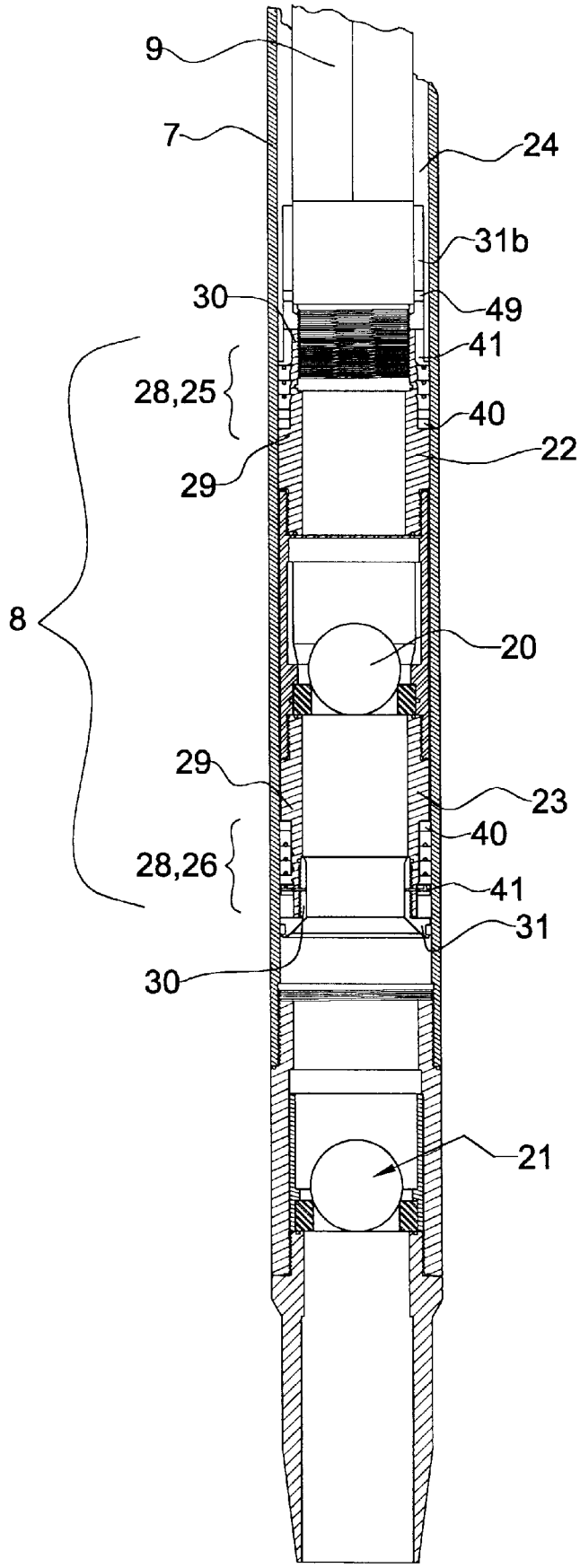
FIG. 9 is a cross-sectional view of the pump showing the piston near the bottom of its downstroke for illustrating the travelling valve, the standing valve and the piston.

Having reference to FIGS. 6–10*b*, the longevity of the pump operation is enhanced significantly by a novel piston and sealing arrangement. As shown in FIG. 9, the piston 8 is an assembly comprising the travelling valve 20, an upper cylindrical end or seal sleeve 22 and a lower cylindrical end or seal sleeve 23. The sleeves 22,23 are substantially identical. An annulus 24 is formed between each sleeve 22,23 and the barrel 7. Seals are mounted on the sleeves 22,23, an upper seal 25 and a lower seal 26 respectively. Each seal 25,26 comprises a plurality of seal rings 27 which are installed as stacks 28 on the sleeves 22,23. The sleeves 22,23 have a base 29 and a tip 30. The base 29 of each sleeve 22,23 is connected to the respective top and bottom of the travelling valve 20. Retainers 31*b*, 31 are secured to each sleeve's tip 30 to secure the stacks 28 on their respective sleeves 22,23. Each seal ring 27 is a hydraulic seal such as those available as "Polypak" (trademark) model #461525003250-375 from Parker Seal Group of Lexington, Ky., USA.

Each seal ring 27 has a leading face 32 (FIG. 6) which is oriented to maintain a pressure differential in one direction. The leading face 32 of each seal ring 27 in the upper seal 25 faces the surface and is effective to create suction in the barrel 7 as the piston rod 9 and piston 8 stroke upwardly The leading face 32 of each seal ring 27 in the lower seal 26 faces the standing valve 21 and is effective to hold pressure in the barrel 7 as the piston rod 9 falls and forces fluid from the barrel into piston rod 9 and the production tubing 10.

Figure 6:
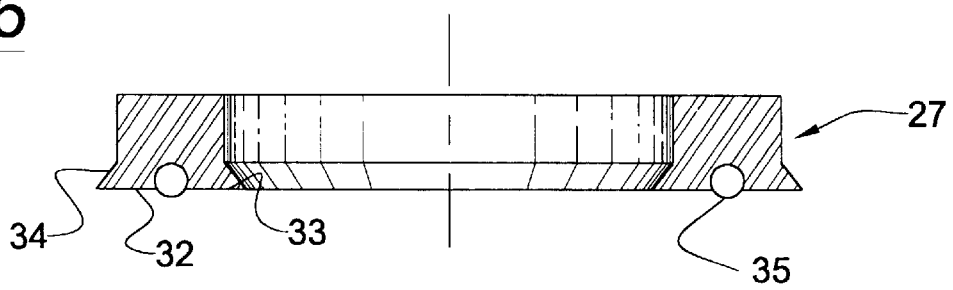
FIG. 6 is cross-sectional view of one of a plurality of hydraulic seal rings used in the pump to surface pump.

Each seal ring 27 and stack 28 is located in the annulus 24. The cross-section of the seal ring 27 is substantially rectangular. As shown in FIG. 6, the leading face 32 is radially flared, having an inner radially-extending lip 33 for engaging the piston 8 and an outer radially-extending lip 34 for engaging the barrel 7. The annulus 24 at the sleeves 22,23 is sized for the width of the seal ring's rectangular cross-section, Accordingly, the flared lips 33,34 are normally compressed into a width of the rectangle cross-section for creating an effective seal against both the piston 8 and the barrel 7 (this lip compression is conceptually depicted as small arcuate marks on FIGS. 7*a* and 7*b*.) The hydraulic seal ring 27 depicted in FIG. 6 has an additional O-ring 35 located midpoint of the ring's cross-section and along the leading edge 32. The additional radial area formed by the O-ring cavity aids in hydraulically driving the lips radially into stronger engagement with their respective sealing surfaces. Not all seal ring manufacturers utilize the additional O-ring concept but most provide the inward and outward lips 33,34.

Having reference to FIGS. 8*a*,8*b*,9 and listed consecutively from the base 29 to the tip 30 of the lower sleeve 23 are: a first retaining ring 40, the seal stack 28, a second retaining ring 41, a rider ring 42, and a wiper ring 43. The seal stack 28 is sandwiched between the retaining rings 40,41. Correspondingly, listed from base to tip, the upper sleeve 22 (FIG. 9) has a first retaining ring 40, the seal stack 28, and a second retaining ring 41. The seal stack 28 is sandwiched between the retaining rings 40,41. The first retainer rings 40 are formed of brass and the second retaining rings 41 are formed of steel. The retainer rings 40,41 are spaced from the barrel 7 so as to avoid contact with the barrel 7. The lower seal 26 is subjected to more sand and accordingly includes both a rider ring 42 formed of Teflon and, more importantly, the wiper 43, formed of Teflon or cast iron. Wiper 43 is a split spring ring with an uncompressed diameter greater than the bore of the barrel 7 which is compressed to fit in the barrel 7.

Each sleeve 22,23 is formed with circumferential grooves 44. The grooves 44 are spaced axially, the spacing being about the axial height of each seal ring 27. The profile of the grooves 44 is complementary to the inner lip 33 of the seal ring 27, i.e. triangular. The retainer rings 40,41 are spaced an axial distance equal to the seal stack 28 plus the height of one groove 44 and thus form a gap 45. Accordingly, the seal stack 28 will be axially movable on their respective sleeves 22,23 between two positions, delimited by the base retaining rings 40 and the tip retaining ring 41.

Figure 7B:
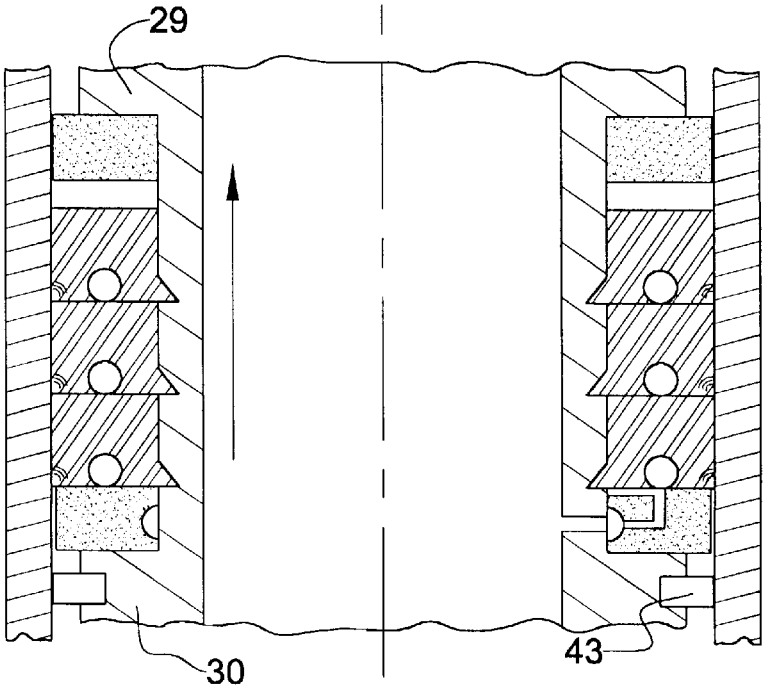
FIG. 7*b* is a simplified diagrammatic representation of the cross-section of the lower piston seal according to FIG. 7*a* which demonstrates the pump's upstroke wherein the seal rings shift axially until the seal rings inner lip engages the sleeve groove, weakening the seal against the piston and thereby avoiding a pressure trap between the upper and lower seals.

When each seal ring 27 moves axially on the sleeve 22,23, the inner lip 33 is compressed against the cylindrical portion of the sleeve proper (i.e. not adjacent a groove, in FIGS. 7*a* and 8*a*) and is decompressed as the inner lip 33 projects into a groove 44 (FIGS. 7*b* and 8*b*). Decompression of the lip 33 interferes with the normally good seal and enables release of pressure past the seal ring 27.

As the seal stack 28 moves between retaining rings 40,41, the inner lips 33 of each of the rings 27 simultaneously engage the grooves 44 (FIGS. 7*b*,8*b*) or alternately, all the inner lips 33 are compressed against the sleeve 22,23 proper (FIGS. 7*a*,8*a*). More particularly, the grooves 44 are axially offset towards the tip 30 of each sleeve 22,23 so that when the seal stack 28 is biased towards the base retaining ring 40, the flared portion 33,34 of the seal rings 27 engage the cylindrical portion of the sleeve 22,23 and form an effective seal. Correspondingly, when the seal stack 28 is biased towards the tip's retaining ring 41, the inner lip 33 engages the groove 44, lessening the sealing action of the seal rings 27.

In summary, seals 25,26 are provided at the leading and trailing end of the piston 8 to keep sand out of the metal-to-metal piston/barrel portions. The upper and lower seals 25,26 cooperate to alternately seal on their respective strokes while the opposing seal releases pressure build up between the seals. Additionally, leading the lower seal 26 is the wiper 43 for excluding the largest part of the sand fines from the piston area.

The steel retaining ring 41 of the lower seal 26 is formed with channels 46 to direct release pressure from the piston 8 and conduct it through ports 47 into the barrel 7 area.

Figures 10A, 10B:
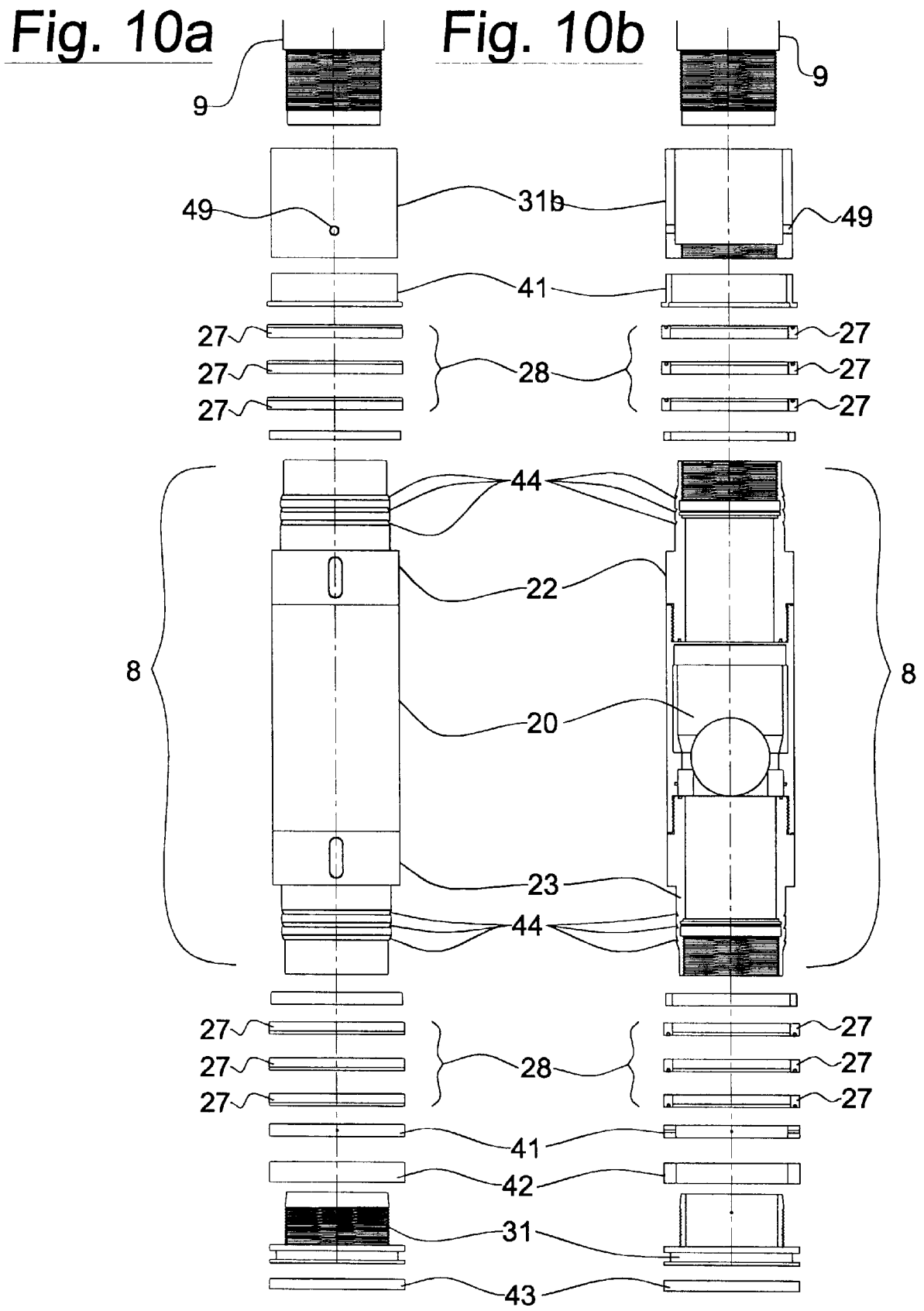
FIG. 10*a* is an exploded side view of the piston, depicting the seals, retaining rings, riders and wipers.
FIG. 10*b* is an exploded cross-sectional view of the pistons depicting the seals, retaining rings, riders and wipers.

Having reference to FIGS. 9–10*b*, the steel retaining ring 41 of the upper seal 25 is held in place with a retainer 31 b, threaded onto the piston rod 9. The retainer 31*b* is axially elongate to limit the upward stroke of the piston 8. This limit ensures the upper seal does not engage vent holes (not shown) usually located at the top of the barrel 7. Set screws 49 lock the retainer 31*b* to the piston rod 9.

The ports 47 are depicted as straight through to the bore of the piston rod 9. Optionally, by axially staggering the ports 47 through the piston 8 from the sleeve 23 through the retainer 31, the pressure release path is forced through one or more threads. Accordingly, should sand be present, it is unable to flow into the lower seal 28.

Figure 4A:
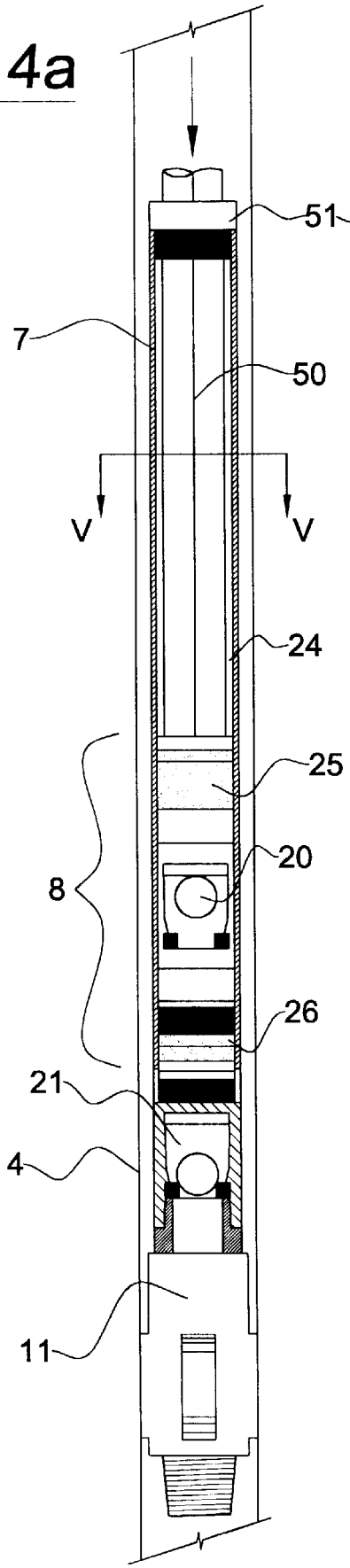
FIGS. 4*a* and 4*b* are cross-sectional views of the first embodiment of the pump to surface pump depicting the positioning of the travelling and standing valves and the polygonal piston rod and complementary bushing, depicting the pump near the bottom of the downstroke and near the top of the upstroke respectively.
Figure 4B:
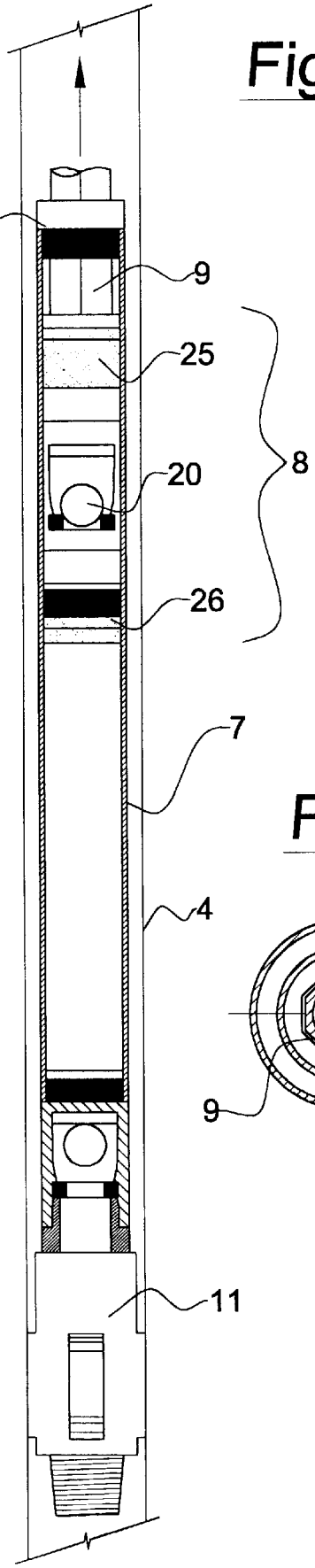
Figure 5:
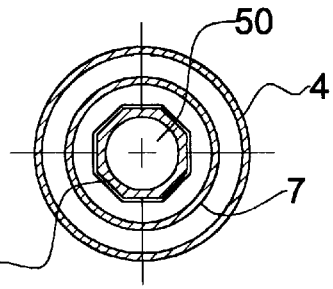
FIG. 5 is a cross-sectional view of the polygonal piston rod at line V—V of FIG. 4*a;*

In a first embodiment and having reference to a diagrammatic illustration of the pump in FIGS. 4*a*,4*b*, the piston rod 9 has a polygonal cross-section and has a longitudinally extending bore 50. The bore 50 has substantially the same internal diameter as that of the production tubing 10. A bushing 51, having a polygonal cross-section complementary to the piston rod 9, is affixed to the top of the barrel 7. The bushing 51 permits reciprocating action of the piston rod 9 but prevents relative rotation of the piston rod 9 and barrel 7. Rotation of the tubing 10 at the surface causes rotation of the piston rod 9. The rod 9 rotates the bushing 51 and barrel 7 for rotational activation of the tension anchor 11. Counter-clockwise tubing rotation can be used to set the anchor 11 and clockwise rotation to unset it.

The piston rod 9 must be sufficiently strong in tension to withstand the cyclic pumping loads and sufficiently strong in torsion to set and unset the tension anchor.

In conventional bailers, a polygonal piston rod is also known however, as described above, the materials of construction are ordinary and the longitudinal bore is small in cross-section, which results in sand drop out, packing of sand in the barrel and troublesome sand wads which bridge flow passages.

In the novel piston rod 9, the outer and internal diameters are maximized so as to minimally restrict the flow of sand-laden oil. To achieve this end, several obstacles had to be overcome. A large dimension polygonal piston rod 9 had to be prepared which has a minimal wall thickness. For 2⅞" production tubing having an internal diameter of 2.441", a piston rod can be provided having dimensions of 3" across the flats of a hexagonal rod, with an internal diameter of 2½". This rod fits within a 3¾" ID barrel as is commercially obtained from Quinn's Oilfield Supply Ltd., of Red Deer, Alberta.

The materials of construction of the polygonal piston rod are improved to 4140 heat treated and stress relieved steel bar stock. The 12 foot long bar stock must be bored with sufficient accuracy to minimize runout and avoid weakening of the rod. Prefably, trepanning is practiced for forming the bore, preferably in combination with careful quality control to ensure the rod's wall thickness does not become too thin locally.

The piston 8, is located at the bottom of the piston rod 9. Piston seals 25,26 extend across the annulus 24 to seal against the inside of the barrel 7. The piston 8 comprises a cylinder within which is located the travelling valve 20, sandwiched between upper and lower seals 25, 26. By positioning of the travelling valve 20 between the upper and lower seals, the minimum dead-space is achieved therebetween. The greater the dead-space, the less effective is the pumping suction capability and the greater is the opportunity for gas-locking.

In operation, when the piston rod 9 falls, the standing valve 21 closes and fluid and sand flow through the travelling valve 20 and into the piston rod 9. When the piston rod 9 rises, the travelling valve 20 closes and the fluid and sand contained therein is lifted on its incremental lift to the surface. Also, as the piston rod 9 rises, more fluid and sand is drawn past the standing valve 21 and into the barrel 7 for the next pumping cycle.

In summary, the novel pump 6 maximizes flow therethrough and thus retains the sand in a suspended state. Flow maximization is achieved in part by standing and travelling valves which have a minimum dead-space between them at the bottom of the piston rod's downstroke, and a high strength piston rod formed with minimum wall thickness and having an internal diameter substantially that of the production tubing diameter.

In a second embodiment (FIGS. 11*a*,11*b*), the polygonal piston rod 9 and bushing 52 is replaced with a dog clutch. Without the need for a polygonal exterior, the piston rod 9 is simply formed from a length of production tubing 10 (i.e. standard 2⅞" tubing having a 2.441" bore), modified to accept the piston 8. Without the polygonal rod and bushing, a rotational lock or dog clutch is provided.

Figures 11A, 11B:
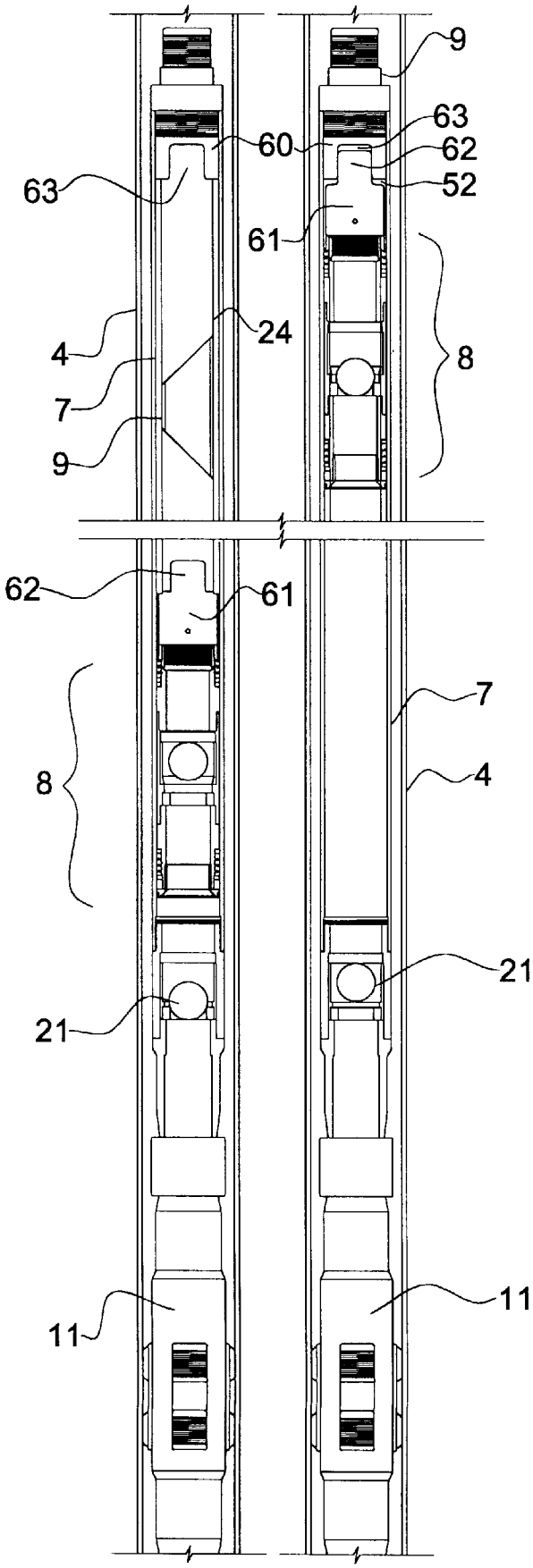
FIGS. 11*a* and 11*b* are cross-sectional views of the second embodiment of the pump to surface pump illustrating the tension anchor-actuating dog clutch, disengaged and engaged respectively.

Referring to FIGS. 11*a*,11*b*, the clutch comprises an upper clutch half 60, and a lower clutch half 61. The clutch halves 60, 61 are formed of cylindrical sleeves which reside within the annulus 24 formed between the piston rod 9 and the barrel 7. The clutch halves 60,61 meet axially and incorporate complementary axially extending and mating tangs 62 and recesses 63. More particularly, the lower clutch half 61 is integrated with the top of the piston, between the piston 8 and the piston rod 9 and comprises a cylindrical sleeve which extends axially and partly up the lower part of the outside of the piston rod 9. The lower clutch half 61 has an outer diameter smaller than the bore of the barrel 7. Two diametrically opposed tangs 62 extend axially upwardly from the lower clutch half 61.

The upper clutch half 60 is also located inside the barrel 7 and is integrated into the top of the barrel 7. The upper clutch half 60 comprises a sleeve extending axially and partly down from the top of the barrel 7. The inside diameter of the upper clutch half 60 is larger than the piston rod 9. Two diametrically opposed axially-upwardly extending recesses 63 are formed in the upper clutch half 60. The recesses 63 and tangs 62 are complementary and suited for axial mating or engagement. Accordingly, when the piston rod 9 is lifted, the tangs 62 of the lower clutch half 61 rise to the top of the pump barrel 7 and engage the recesses 63 of the upper clutch half 62. Once the engaged, rotation of the production tubing 10 at the surface causes the barrel 7 to rotate also, operating the tension anchor 11.

EXAMPLE

Figure 12:
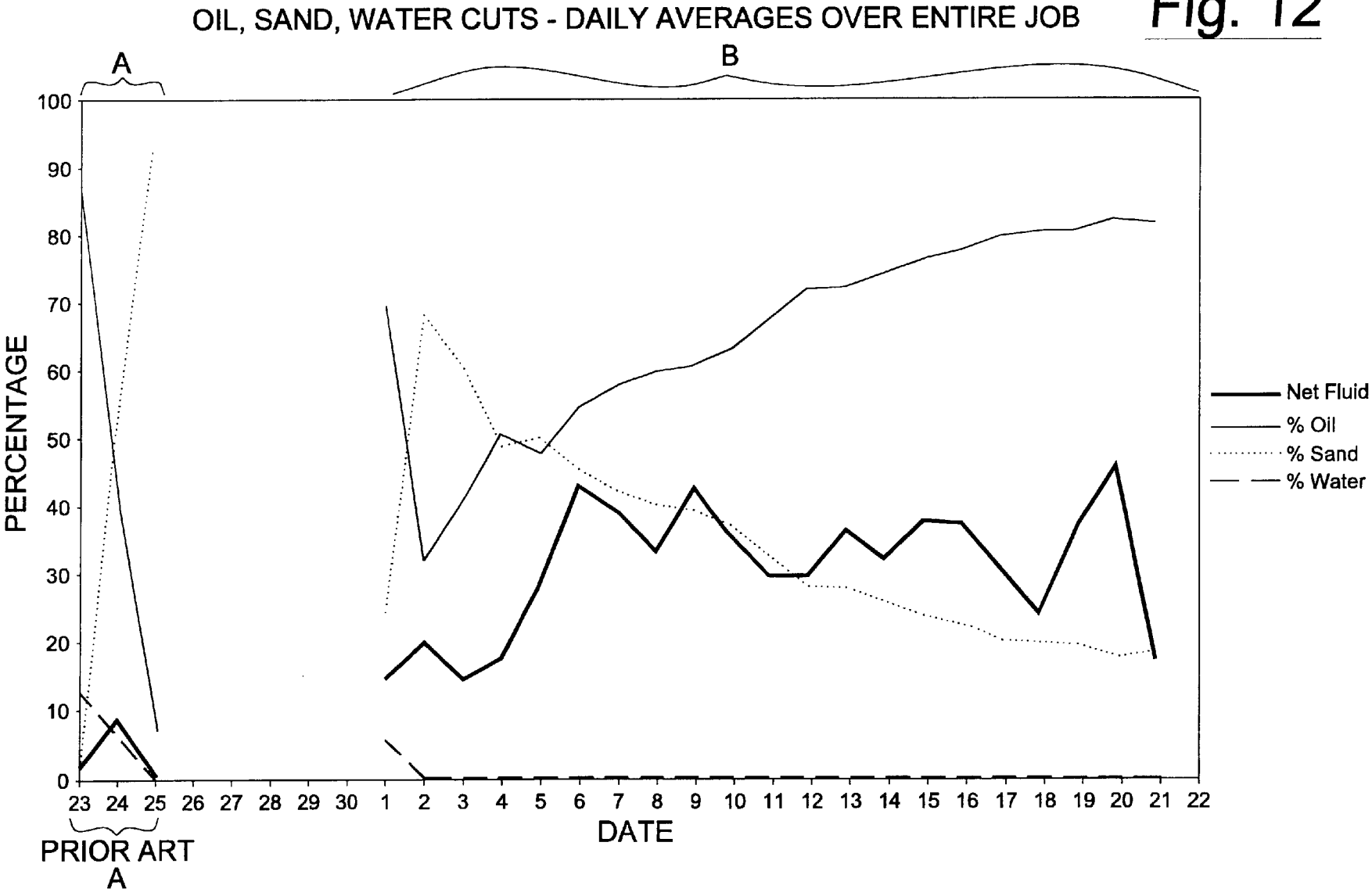
FIG. 12 is a chart depicting a comparison of the performance of a prior art converted bailer pump and a pump provided in accordance with the first embodiment and applied in the Example.

Having reference to FIGS. 12 a well in Southern Alberta was run first with a competitor's commercial pump (a bailer conversion) and secondly with a pump 9 constructed in accordance with the invention. The well was perforated at about 773 m.

As shown at A, the competitor's pump was run for only 30 hours before it sanded off. In other words, it was not removing the sand which was flowing into the well. As service rig was called in to change pumps. Upon post-operation inspection, the competitors pump barrel and seals exhibited extreme damage.

The novel pump, according to the first embodiment, was installed. The pump was fitted to string of 3½" tubing having a 3" inside diameter. Five lengths or about 45 m of 3½" tailpipe were installed. A flapper valve was used at the bottom of the tailpipe. The piston rod was reciprocated with 3 m stroke at about 1½ to 2 strokes per minute.

As shown at B, initial oil and sand production was about 14.5 m3/d at 70% sand. The fraction of sand dropped steadily over the next 21 days to stabilize at about 17% Correspondingly, the oil production (less sand) rose to about 82%. Over this 21 day period, about 470 m3 of oil were produced for an average of 22 m3/d. A failure of the tension anchor interrupted production. Subsequently, a further 17 days of operation were achieved (not shown), some of which were achieved with a 1¼" piece of shale wedged in the travelling valve with continued marginal production at 14 m3/d.

The pump was disassembled and inspected after the run. As stated, a 1¼" piece of shale was found wedged in the travelling valve. The barrel and piston were inspected. There were no signs of wear or seal damage from the sand.

The embodiments of the invention in which an exclusive property or privilege is claimed are defined as follows:

1. An improved pump for co-producing sand and oil from a subterranean well and delivering the sand and oil up a production tubing sting extending downwardly from the surface, the pump being located in the well and actuated by a reciprocating member extending downward from the surface, the pump having a cylindrical pump barrel having a lower inlet, means for anchoring the barrel in the well and a one-way standing valve positioned at the bottom of the barrel for admitting well fluids, the improvement comprising:

a cylindrical piston rod suspended from the reciprocating member and rotatable with the reciprocating member, said piston rod having an outside diameter maximized for fitting the barrel and a bore, the inside diameter of the bore being maximized;

means positioned between the piston rod and the barrel for permitting reciprocating movement therebetween but preventing relative rotation;

a piston positioned at the bottom of the piston rod and movable axially within the barrel and forming an annulus therebetween, said piston having an upper end adjacent the piston rod and a lower end;

a one-way travelling valve located between the upper end and the lower end;

upper seal means for drawing a suction in the barrel during an upstroke of the piston and being located in the annulus between the piston and the barrel, positioned above the travelling valve; and lower seal means for pressuring the barrel on a downstroke of the piston and being located in the annulus between the piston and the barrel, positioned below the travelling valve; and a wiper ring for excluding sand from the upper and lower seal means, the wiper being located in the annulus between the piston and the barrel and positioned axially between the lower end of the piston and the lower seal means, said wiper being radially compressible and having an uncompressed diameter larger than the diameter of the barrel.

2. The pump as recited in claim 1 wherein said lower seal means comprises:

a lower cylindrical sleeve extending axially from a base adjacent the travelling valve to a tip and forming a lower seal annulus between said lower sleeve and the barrel;

a pair of retaining rings spaced axially on the sleeve, one positioned adjacent the base and one positioned adjacent the tip;

one or more hydraulic seal rings each having a leading edge oriented towards the tip and which is radially flared, said seal ring or seal rings being stacked axially seal ring-to-seal ring in the lower seal annulus, said seal stack being located between said retaining rings so that the flared leading edge is compressed against both the lower sleeve and the barrel, the axial height of said seal stack being less than the spacing between the base and tip retaining rings so as to form a gap and enable the seal stack to move within the lower seal annulus between a first position bearing against the base retaining ring during a downstroke and a second position bearing against the tip's retaining ring during an upstroke;

one or more circumferential and axially spaced grooves formed in the lower sleeve, the number of grooves corresponding to the number of seal rings, the profile of the grooves being matched to the flared leading edge the spacing of the grooves corresponding to the axial spacing of the flared leading edges of the seal rings in the stack, the grooves being axially offset slightly towards the tip so at the first position the flared portion of the seal rings engage a cylindrical portion of the lower sleeve and form an effective seal, and conversely at the second position, the flared portions of the seal rings engage their respective grooves, lessening the sealing action of the seal rings.

3. The pump as recited in claim 2 wherein the lower seal means further comprises:

one or more passageways leading from the lower seal annulus through to the bore of the piston rod for release of pressure when the seal stack moves to the second position.

4. The pump as recited in claim 3 wherein said upper seal means comprises:

an upper cylindrical sleeve extending axially from a base adjacent the travelling valve to a tip and forming an upper seal annulus between said upper sleeve and the barrel;

a pair of retaining rings spaced axially on the lower sleeve, one positioned adjacent the base and one positioned adjacent the tip;

one or more hydraulic seal rings each having a leading edge oriented towards the tip and which is radially flared, said seal ring or seal rings being stacked axially seal ring-to-seal ring on the lower sleeve, said seal stack being located between said retaining rings and occupying the annulus to that the flared leading edge is compressed against both the upper sleeve and the barrel.

5. The pump as recited in claim 4 wherein the axial height of the seal stack of said upper seal means is less than the spacing between the base and tip retaining rings of the upper seal means so as to form a gap and enable the seal stack to move between a first position bearing against the base retaining ring during an upstroke and a second position bearing against the tip's retaining ring during an downstroke, said upper seal means further comprising one or more circumferential and axially spaced grooves formed in the upper sleeve, the number of grooves corresponding to the number of seal rings, the profile of the grooves being matched to the flared leading edge the spacing of the grooves corresponding to the axial spacing of the flared leading edges of the seal rings in the seal stack, the grooves being axially offset slightly towards the tip so that at the first position the flared portion of the seal rings engage a cylindrical portion of the upper sleeve and form an effective seal, and conversely at the second position the flared portions of the seal rings engage their respective grooves, lessening the sealing action of the seal rings.

6. The pump as recited in claim 5 wherein the anchoring means is rotationally actuated and wherein the rod anti-rotation means comprises:

a piston rod being formed of a high strength material and having a non-circular regular exterior cross-section with a maximized bore and a minimal wall thickness; and a bushing integral with the barrel, through which the piston rod extends slidably, the bushing interior being keyed to the rod exterior so that rotation of the rod causes rotation of the bushing, the barrel and the anchoring means.

7. The pump as recited in claim 6 wherein the exterior cross-section of the piston rod and the bushing interior are polygonal.

8. The pump as recited in claim 6 wherein the piston rod is formed by trepanning for forming a bore of maximum diameter in the piston rod with minimal runout.

9. The pump as recited in claim 15 wherein the anchoring means is rotationally actuated and wherein the rod anti-rotation means comprises:

an upper cylindrical sleeve fitted to the top of the barrel and located in the annulus formed between the piston rod and the barrel;

a lower cylindrical sleeve fitted to the top of the piston and located in the annulus formed between the piston rod and the barrel;

axially extending, opposing and complementary tangs and recesses formed in the upper and lower cylindrical sleeves wherein upon reciprocating the piston to its highest position in the barrel, tangs engage complementary and opposing recesses so that upon rotation of the piston rod at this highest position, the barrel is also caused to rotate.

10. The pump as recited in claim 3 wherein the anchoring means is rotationally actuated and wherein the rod anti-rotation means comprises:

the piston rod formed of a high strength material and having a non-circular regular exterior cross-section with a maximized bore and a minimal wall thickness; and a bushing integral with the barrel, through which the piston rod extends slidably, the bushing interior being keyed to the rod exterior so that rotation of the rod causes rotation of the bushing and barrel.

11. The pump as recited in claim 10 wherein the exterior cross-section of the piston rod and the bushing interior are polygonal.

12. The pump as recited in claim 1 wherein the travelling valve has first and second ends and the piston further comprises:

a first cylindrical sleeve forming an annulus between said first sleeve and the barrel, said first sleeve having a base connected to the first end of the travelling valve, said first sleeve extending axially to a tip;

a second cylindrical sleeve forming an annulus between said second sleeve and the barrel, said second sleeve having a base connected to the second end of the travelling valve, said second sleeve extending axially to a tip;

one or more hydraulic ring seals stacked axially on each of the first and second cylindrical sleeves between retaining rings positioned at the sleeve base and tip, the spacing between the retaining rings being greater that the stack of rings, each hydraulic ring seal having a flared leading edge;

one or more circumferential and axially spaced grooves formed in the sleeves, the number of grooves corresponding to the number of seal rings, the spacing of the grooves corresponding to the axial positioning of the flares of each of the seal rings, the grooves being axially offset towards the tip of each sleeve so that when the stack of seal rings is biased towards the base retaining ring, the flared portion of the seal rings engage the cylindrical portion of the sleeve and form an effective seal, and so that when the stack of seal rings is biased towards the tip retaining ring, the flared portion engages the groove, lessening the sealing action of the seal rings.

13. The pump as recited in claim 5 wherein the anchoring means is rotationally actuated and wherein the rod anti-rotation means comprises:

an upper cylindrical sleeve fitted to the top of the barrel and located in the annulus formed between the piston rod and the barrel;

a lower cylindrical sleeve fitted to the top of the piston and located in the annulus formed between the piston rod and the barrel; and axially extending, opposing and complementary tangs and recesses formed in the upper and lower cylindrical sleeves wherein upon reciprocating the piston to its highest position in the barrel, tangs engage complementary and opposing recesses so that upon rotation of the piston rod at this highest position, the barrel is also caused to rotate.

14. The pump as recited in claim 2 wherein the reciprocating member is the tubing string having a longitudinal bore and wherein the piston rod has a longitudinal bore which is contiguous with tubing string's bore.

15. The pump as recited in claim 14 wherein the piston rod is formed of a high strength material so that its longitudinal bore can be maximized so as to be substantially the same diameter as the tubing string's bore.

16. An improved seal for a reciprocating piston in a cylindrical barrel for pumping fluid, comprising:

a first cylindrical sleeve on the outer circumference of the piston for forming a seal annulus between the piston and the barrel along at least a portion of the piston;

a first base retaining ring and a first tip retaining ring spaced axially on the sleeve;

a first stack of one or more seal rings, each seal ring having a leading edge oriented towards the piston's lower end and which is radially flared, each seal ring being stacked axially seal ring-to-seal ring in the seal annulus, said seal stack being located between said retaining rings so that the flared leading edge is compressed against both the sleeve and the barrel, the axial height of said seal stack being less than the spacing between the trailing and leading retaining rings so as to form a gap and enable the seal stack to move within the seal annulus between a first position bearing against the base retaining ring and a second position bearing against the tip's retaining ring; and one or more circumferential and axially spaced grooves formed in the sleeve, the number of grooves corresponding to the number of seal rings, the profile of the grooves being matched to the uncompressed flared leading edge, the spacing of the grooves corresponding to the axial spacing of the flared leading edges of the seal rings in the stack, the grooves being axially offset slightly towards the pistons leading edge so at the first position the flared portion of the seal rings engage a cylindrical portion of the sleeve and form an effective seal, and conversely at the second position, the flared portions of the seal rings engage their respective grooves, lessening the sealing action of the seal rings.

17. An improved seal for a reciprocating piston as recited in claim 16 wherein the fluid contains sand further comprising:

a wiper ring located adjacent the piston's lower end so that substantially all sand is excluded from the sleeve and from the stack of one or more seal rings.

18. An improved seal for a reciprocating piston as recited in claim 17 wherein:

the piston has upper and lower ends, a longitudinal bore and a one-way valve located intermediate the upper and lower ends so that, in the first position, fluid flows through the one-way valve and into the piston's bore, and in the second position the one-way valve closes and fluid is driven before the upper end;

the first cylindrical sleeve, the first base retaining ring, the first tip retaining ring, the first stack of one or more seal rings, and the first stacks seal ring's corresponding sleeve grooves are located on the piston's lower end and the ring seal's leading edges are oriented towards the piston's lower end; the improved seal further comprising:

a second cylindrical sleeve, second base retaining ring, second tip retaining ring, second stack of one or more seal rings, and corresponding sleeve grooves which are located on the piston's upper end and wherein the second stack's seal ring's leading edges are oriented towards the piston's upper end.

* * * * *